US010813504B2

(12) United States Patent
Harding

(10) Patent No.: US 10,813,504 B2
(45) Date of Patent: Oct. 27, 2020

(54) PORTABLE CAMPGROUND SINK

(71) Applicant: Kenneth Harding, Goodyear, AZ (US)

(72) Inventor: Kenneth Harding, Goodyear, AZ (US)

( * ) Notice: Subject to any disclaimer, the term of this patent is extended or adjusted under 35 U.S.C. 154(b) by 119 days.

(21) Appl. No.: 16/231,741

(22) Filed: Dec. 24, 2018

(65) Prior Publication Data

US 2019/0125135 A1 May 2, 2019

Related U.S. Application Data

(63) Continuation-in-part of application No. 15/831,914, filed on Dec. 5, 2017.

(60) Provisional application No. 62/430,099, filed on Dec. 5, 2016.

(51) Int. Cl.

| | |
|---|---|
| ***A47K 1/02*** | (2006.01) |
| ***E03C 1/32*** | (2006.01) |
| ***E03C 1/18*** | (2006.01) |

(52) U.S. Cl.

CPC ..... *A47K 1/02* (2013.01); *E03C 1/18* (2013.01); *E03C 1/32* (2013.01)

(58) Field of Classification Search

CPC .... A47K 1/02; A47K 1/04; E03C 1/18; E03C 1/32

USPC ..... 4/643

See application file for complete search history.

(56) References Cited

U.S. PATENT DOCUMENTS

| | | | |
|---|---|---|---|
| 2,663,392 | A | 12/1953 | Miller |
| 3,871,399 | A | 3/1975 | Watson |
| 5,667,256 | A | 9/1997 | Caine |
| 5,881,404 | A | 3/1999 | Knight |
| 6,427,259 | B1 | 8/2002 | Cawthon |

*Primary Examiner* — Christine J Skubinna

(74) *Attorney, Agent, or Firm* — Boudwin Intellectual Property; Daniel Boudwin

(57) ABSTRACT

A portable campground sink. The portable campground sink includes a frame having at least one sidewall, wherein an interior portion of the frame is divided into a first section and a second section by a cross bar. A plurality of legs are removably affixed to the frame, wherein the plurality of legs extend perpendicularly away from the frame. A container having an upper compartment in liquid communication with a lower compartment is received by the frame such that the lower compartment lies within the first section. An outlet is disposed on the lower compartment can receive a hose thereon. An adaptor having an inlet that can receive the hose thereon can be removably secured within a sewer drain such that the contents of the lower compartment exit through the outlet, through the hose, into the inlet, and out of the adaptor into the sewer drain.

20 Claims, 8 Drawing Sheets

PORTABLE CAMPGROUND SINK

CROSS REFERENCE TO RELATED APPLICATIONS

This application is a continuation in part of U.S. application Ser. No. 15/831,914 filed on Dec. 5, 2017, which claims the benefit of U.S. Provisional Application No. 62/430,099 filed on Dec. 5, 2016. The above identified patent applications are herein incorporated by reference in their entirety to provide continuity of disclosure.

BACKGROUND OF THE INVENTION

The present invention relates to portable campground sinks. Specifically, the present invention relates to portable campground sinks having a container in liquid communication with an adaptor configured to secure within a sewer drain, such that the contents of the container are drained through the sewer.

Many people enjoy camping and carry tubs and basins for cleaning dishes, tools, fish, and the like. This, however, leads to dirty used water being dumped on the ground rather than in a septic system, as the basins are not capable of being connected to a drain. Due to this, many people choose to wash dishes and the like indoors, either in their camper or on camp facilities. However, this can lead to significant messes in an otherwise small living area, such as that of an RV. Others choose to leave the mess outdoors, which can cause inconvenience to others who have clean up the affected area before use, or put up with unsightly messes and odors. Therefore, a portable campground sink system that can connect to a sewer drain is desired.

In light of the devices disclosed in the known art, it is submitted that the present invention substantially diverges in design elements from the known art and consequently it is clear that there is a need in the art for an improvement to existing portable campground sinks. In this regard, the instant invention substantially fulfills these needs.

SUMMARY OF THE INVENTION

In view of the foregoing disadvantages inherent in the known types of portable campground sinks now present in the prior art, the present invention provides a portable campground sink wherein the same can be utilized for providing convenience for the user when washing dishes or otherwise utilizing an outdoor sink when camping.

The present system comprises a frame having at least one sidewall, wherein an interior portion of the frame is divided into a first section and a second section by a cross bar. A plurality of legs are removably affixed to the frame, wherein the plurality of legs extend perpendicularly away from the frame. The system further comprises a container having an upper compartment defining an upper interior volume and a lower compartment disposed on a lower side of the upper compartment, wherein the lower compartment defines a lower interior volume and the upper compartment is in liquid communication with the lower compartment. An outlet is disposed on the lower compartment, wherein the outlet is configured to removably receive a hose thereon. The container is configured such that a lower surface of the upper compartment rests flush on an upper surface of the frame, wherein the lower compartment is received within the first section. The system further comprises an adaptor having an inlet, wherein the inlet is configured to removably receive a hose thereon. The inlet is in liquid communication with an open lower end of the adaptor, wherein the open lower end is configured to removably secure within a sewer drain.

In some embodiments, the system further comprises a lid configured to removably secure to an upper side of the upper compartment such that the upper interior volume is enclosed thereby. In another embodiment, the lid comprises a first portion hingedly affixed to a second portion such that the first portion is configured to pivot away from the container. In other embodiments, the lid further comprises a plurality of slats disposed at intervals extending from an underside of the lid. In yet another embodiment, the lid further comprises a pair of cutouts disposed on opposing lateral sides of the lid, wherein the pair of cutouts are configured to expose the upper side of the upper compartment. In some embodiments, the system further comprises a strainer configured to rest on a base of the upper compartment, wherein the strainer comprises a plurality of apertures configured to allow liquid to pass therethrough. In another embodiment, the strainer further comprises an opening configured to receive a finger therethrough. In other embodiments, a base of the upper compartment is sloped towards the lower compartment. In yet another embodiment, a floor of the lower compartment is sloped towards the outlet. In some embodiments, the second section is configured to receive the adaptor therein. In another embodiment, the second section further comprises a lip disposed on the cross bar and an interior surface of the sidewall, wherein the lip is configured to receive the adaptor thereon. In other embodiments, the open lower end comprises a plurality of tiers of decreasing diameter from a top end of the adaptor to a bottom end of the adaptor, wherein each tier is configured to engage with a sewer drain of a corresponding diameter. In yet another embodiment, the plurality of tiers are configured to engage the sewer drain via threaded engagement. In some embodiments, the adaptor further comprises a cover removably secured to a top end thereof. In another embodiment, the plurality of legs comprises a plurality of segments, wherein the plurality of segments are configured to removably secure to each other to adjust the height of the plurality of legs. In other embodiments, a distal end of each of the plurality of legs is beveled. In yet another embodiment, a proximal end of each of the plurality of legs is received within the frame. In some embodiments, the sidewall further comprises a plurality of slots configured to allow the plurality of legs to be secured along various heights within the frame.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
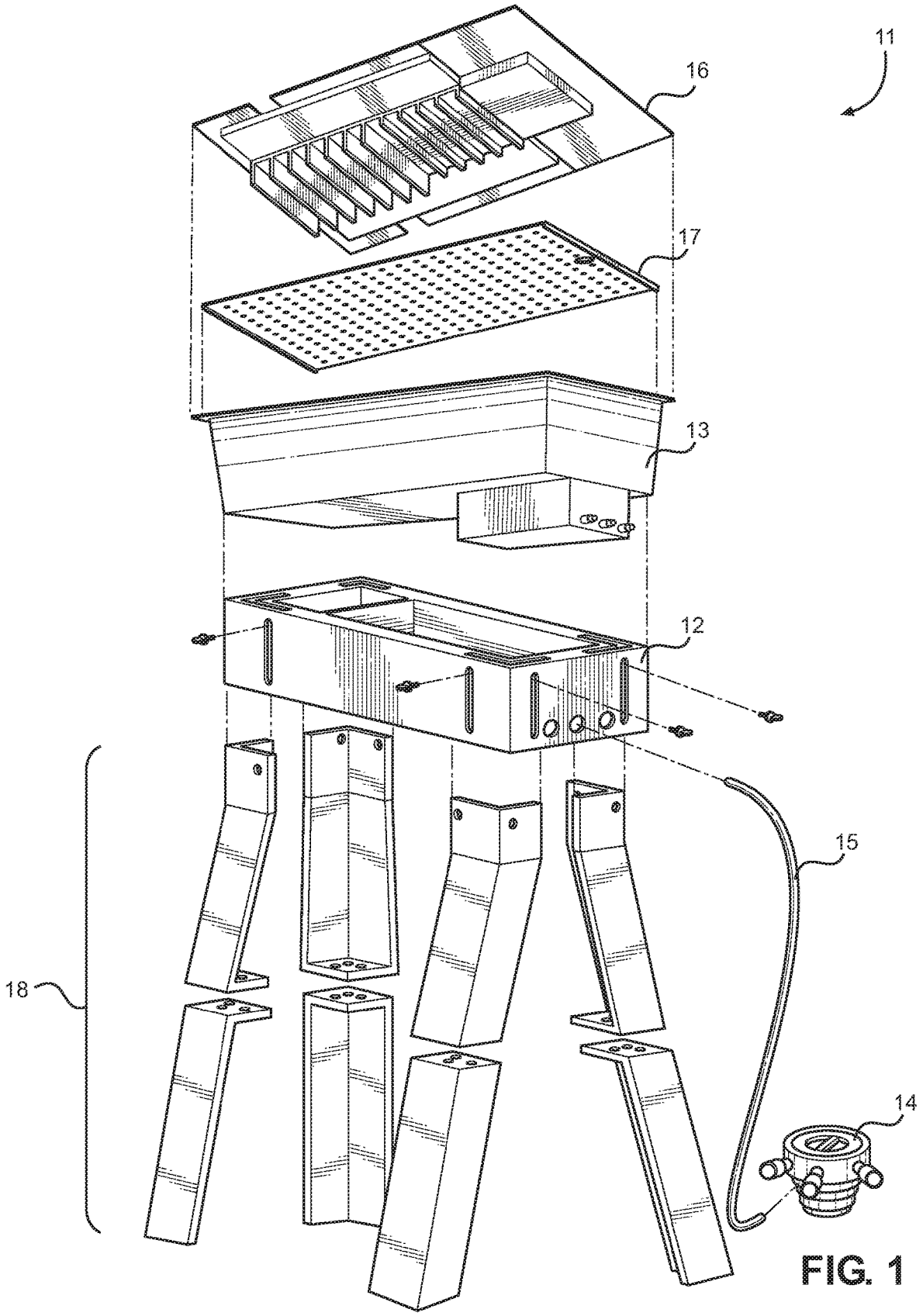
FIG. 1 shows an exploded view of an embodiment of the portable campground sink.

Reference is made herein to the attached drawings. Like reference numerals are used throughout the drawings to depict like or similar elements of the portable campground sink. The figures are intended for representative purposes only and should not be considered to be limiting in any respect.

Referring now to FIG. 1, there is shown an exploded view of an embodiment of the portable campground sink. The portable campground sink 11 comprises a frame 12 having a plurality of legs 18 removably affixed thereto. In the illustrated embodiment, the plurality of legs 18 are angled outwardly relative to the frame 12, such that the plurality of legs 18 provide increased stability to the portable campground sink 11. A container 13 is configured to be received by the frame 12, such that a lower portion of the container 13 is configured to rest thereon. A hose 15 is removably securable to an outlet of the container 13 at a first end thereof, and an adaptor 14 is removably securable to an opposing second end of the hose 15. In some embodiments, the hose 15 further comprises a valve disposed thereon, wherein the valve is configured to move between an open position and a closed position, such that liquid can pass through the hose when the valve is in the open position and cannot pass through the hose when the valve is in the closed position. When attached to both the container 13 and the adaptor 14, the hose 15 allows the contents of the container 13 to drain therethrough into the adaptor 14 and into a sewer or other drainage location. In the illustrated embodiment, a strainer 17 is configured to rest within the container 13. A lid 16 is removably securable to the container 13 such that it selectively rests on the container 13, thereby selectively enclosing an interior volume of the container 13. In this way, the portable campground sink 11 comprises a series of removably securable components, allowing the portable campground sink 11 to be disassembled for ease of storage and transportation.

Figure 2:
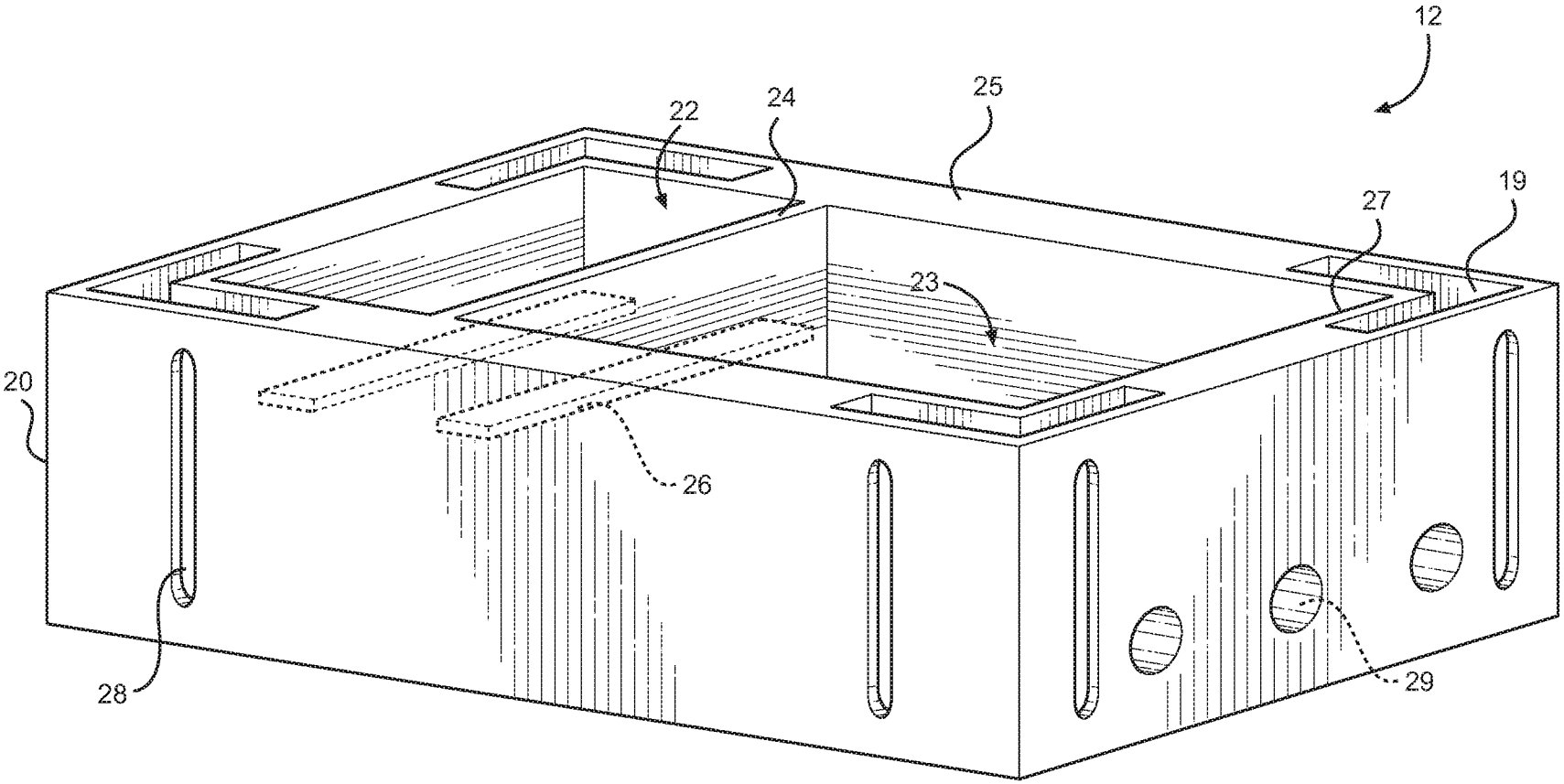
FIG. 2 shows a perspective view of the frame of an embodiment of the portable campground sink.

Referring now to FIG. 2, there is shown a perspective view of the frame of an embodiment of the portable campground sink. The frame 12 comprises at least one sidewall 20 defining an interior portion of the frame 12. The interior portion of the frame 12 is divided into a first portion 22 and a second portion 23 by a cross bar 24 extending between opposing sidewalls 20. The first portion 22 is sized and configured to receive the adaptor therein, while the second portion 23 is configured to receive a lower compartment (shown in FIG. 3, 32) therein such that an outlet (shown in FIG. 3, 35) extends through a hole 29 disposed through the sidewall 20. In the illustrated embodiment, a plurality of outlets are disposed on the lower compartment, such that each outlet is configured to extend through a complementary hole 29 disposed in the sidewall 20. Alternate embodiments having varying numbers of outlets and complementary holes 29 disposed through the sidewall 20 are contemplated. In the illustrated embodiment, the first portion 22 further comprises a lip 26 extending along the cross bar 24 and an interior surface 27 of the sidewall 20 opposite the cross bar 24, such that the lip 26 is configured to support the adaptor thereon. In this way, the user can store the adaptor within the first portion 22 when the adaptor is not in use for ease of transport and storage. The frame 12 is further configured to receive the container thereon, such that a lower surface (shown in FIG. 3, 36) of an upper compartment (shown in FIG. 3, 30) rests flush on an upper surface 25 of the frame 12.

In the illustrated embodiment, the frame 12 further comprises a plurality of L-shaped openings 19 disposed on an upper edge of the sidewalls 20, wherein the plurality of L-shaped openings 19 are configured to receive the plurality of legs therethrough. In the illustrated embodiment, the frame 12 further comprises a plurality of slots 28 disposed in the sidewall 20, wherein each of the plurality of slots 28 is aligned with each side of the L-shaped openings 19, such that the plurality of legs can be selectively secured to the frame 12 along the plurality of slots 28 via one or more fasteners inserted therethrough. In this way, the height of the plurality of legs can be adjusted along the height of the frame 12.

Figure 3:
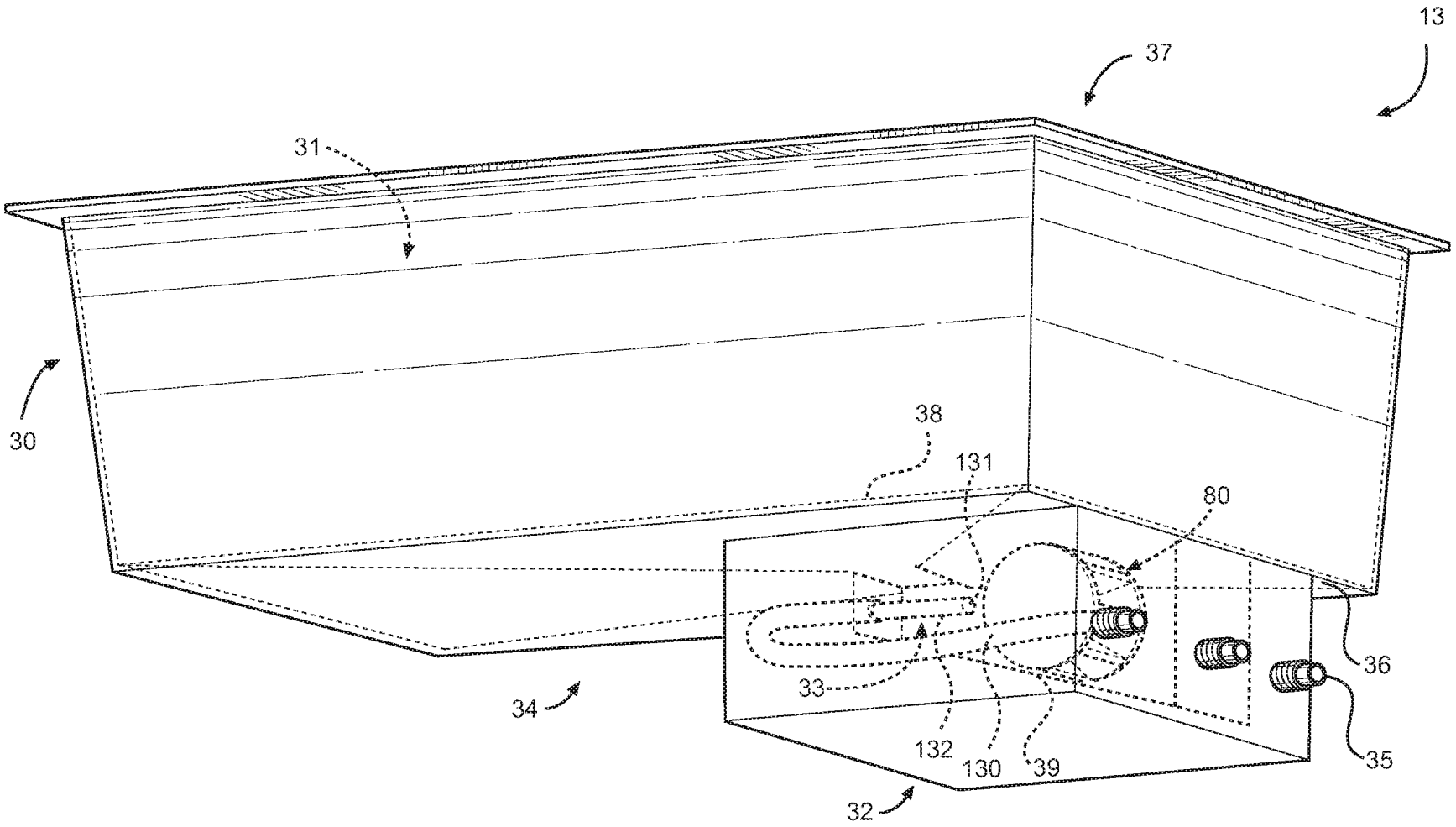
FIG. 3 shows a perspective view of the container of an embodiment of the portable campground sink.

Referring now to FIG. 3, there is shown a perspective view of the container of an embodiment of the portable campground sink. The container 13 comprises an upper compartment 30 having an upper interior volume 31 and a lower compartment 32 disposed on a lower side 34 of the upper compartment 30, wherein the lower compartment 32 comprises a lower interior volume 33. The upper and lower compartments 30, 32 are connected such that the upper and lower interior volumes 31, 33 are in liquid communication with each other. In this way, liquid within the upper interior volume 31 can drain into the lower interior volume 33. An outlet 35 is disposed on the lower compartment 32, wherein the outlet 35 is configured to removably receive the hose thereon. In the illustrated embodiment, a plurality of outlets 35 are shown, wherein each of the plurality of outlets 35 is in fluid communication with the lower interior volume 33. In the shown embodiment, one of the plurality of outlets 35 includes a tube 130 affixed thereto, wherein the tube 130 is configured to extend into the lower interior volume 33. A distal end 132 of the tube 130 comprises an opening 131 therethrough, wherein the opening 131 is positioned within the lower interior volume 33 such that fluid expelled therethrough impacts a macerator wheel 80 disposed within the lower interior volume 33. In this way, fluid expelled through the opening 131 causes the macerator wheel 80 to rotate, such that the macerator wheel 80 can break up and disperse debris within the lower interior volume 33, such that the debris can be easily drained therefrom. In this way, the fluid flow through the lower compartment 32 is unimpeded by debris forming blockages, thereby allowing a user to continually use the portable campground sink. In some embodiments, the distal end 132 of the tube 130 tapers radially inwardly along opposing sides thereof, such that the opening 131 forms an ovoid shape. This tapering creates a nozzle on the distal end 132 of the tube 130, thereby increasing the fluid pressure output thereby, allowing the tube 130 to drive the macerator wheel 80 more effectively.

In the illustrated embodiment, the outlet 35 is configured to removably receive the hose thereon via threaded engagement, however other securement options, including snap fit, friction fit, and the like are contemplated. In the illustrated embodiment, one of the outlets 35 is configured to removably secure to a water line to provide pressure to the macerator wheel 80, causing the macerator wheel 80 to spin within the lower compartment 32. A second outlet 35 connects to the hose to drain through the adaptor. A third outlet 35 is configured to fill the lower interior volume 33 with fluid, such that the lower interior volume 33 can efficiently drain. The outlet 35 is further configured to extend through the frame when the container 13 is placed thereon. When the container 13 is placed on the frame, the lower surface 36 of the upper container 30 is configured to rest flush on the frame. In this way, the container 13 is maintained in a level position relative to the frame.

In the illustrated embodiment, the upper compartment 30 further comprises a base 38, wherein the base 38 is sloped towards the lower compartment 32 such that the contents of the upper interior volume 31 travel along the sloped base 38 to drain into the lower interior volume 33. In the illustrated embodiment, the lower compartment 32 further comprises a sloped floor 39, wherein the floor 39 slopes downwards at an angle toward the outlet 35. In this way, the contents of the lower interior volume 33 are configured to travel along the sloped floor 39 towards the outlet 35, such that the contents of the lower interior volume 33 can exit the container 13 through the outlet 35.

Figure 4:
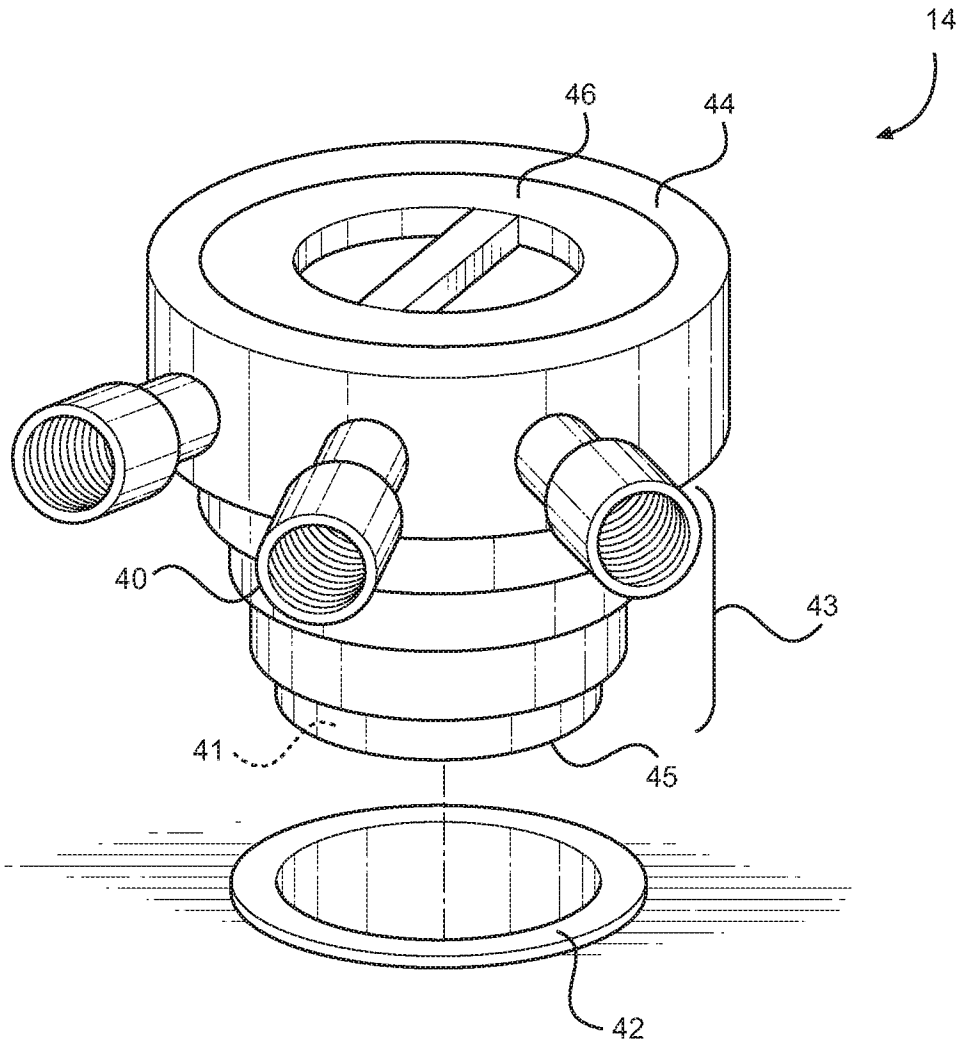
FIG. 4 shows a perspective view of the adaptor of an embodiment of the portable campground sink.

Referring now to FIG. 4, there is shown a perspective view of the adaptor of an embodiment of the portable campground sink. The adaptor 14 comprises one or more inlets 40 configured to removably secure the hose thereon. In the illustrated embodiment, the adaptor 14 comprises a plurality of inlets 40, wherein each inlet 40 is configured to removably secure the hose via threaded engagement, however other securement options are contemplated, including snap fit, friction fit, and the like. The plurality of inlets 40 allow multiple drainage lines to be secured to the frame simultaneously. The inlet 40 is in liquid communication with an open lower end 41 of the adaptor 14, such that liquid entering the inlet 40 exits the adaptor 14 through the open lower end 41. In the illustrated embodiment, the open lower end 41 comprises a plurality of tiers 43, wherein the plurality of tiers 43 are configured to decrease in diameter from a top end 44 of the adaptor 14 towards a bottom end 45 of the adaptor 14. The plurality of tiers 43 are configured to removably secure the open lower end 41 within a sewer drain 42. The plurality of tiers 43 of various diameters allows a user to removably secure the adaptor 14 within a variety of different diameters of sewer drains 42. In some embodiments, the plurality of tiers 43 are configured to removably secure within the sewer drain 42 via threaded engagement, however other securement options such as friction fit, snap fit, and the like are contemplated. In some embodiments, one of the plurality of tiers 43 is configured to rest flush on the lip, such that the adaptor 14 can be stored within the frame. In the illustrated embodiment, the adaptor 14 further comprises a cover 46 configured to removably secure to the top end 44 of the adaptor 14. In this way, the cover 46 can be removed to allow access to the interior of the adaptor 14 for cleaning and additional drainage purposes.

Figure 5:
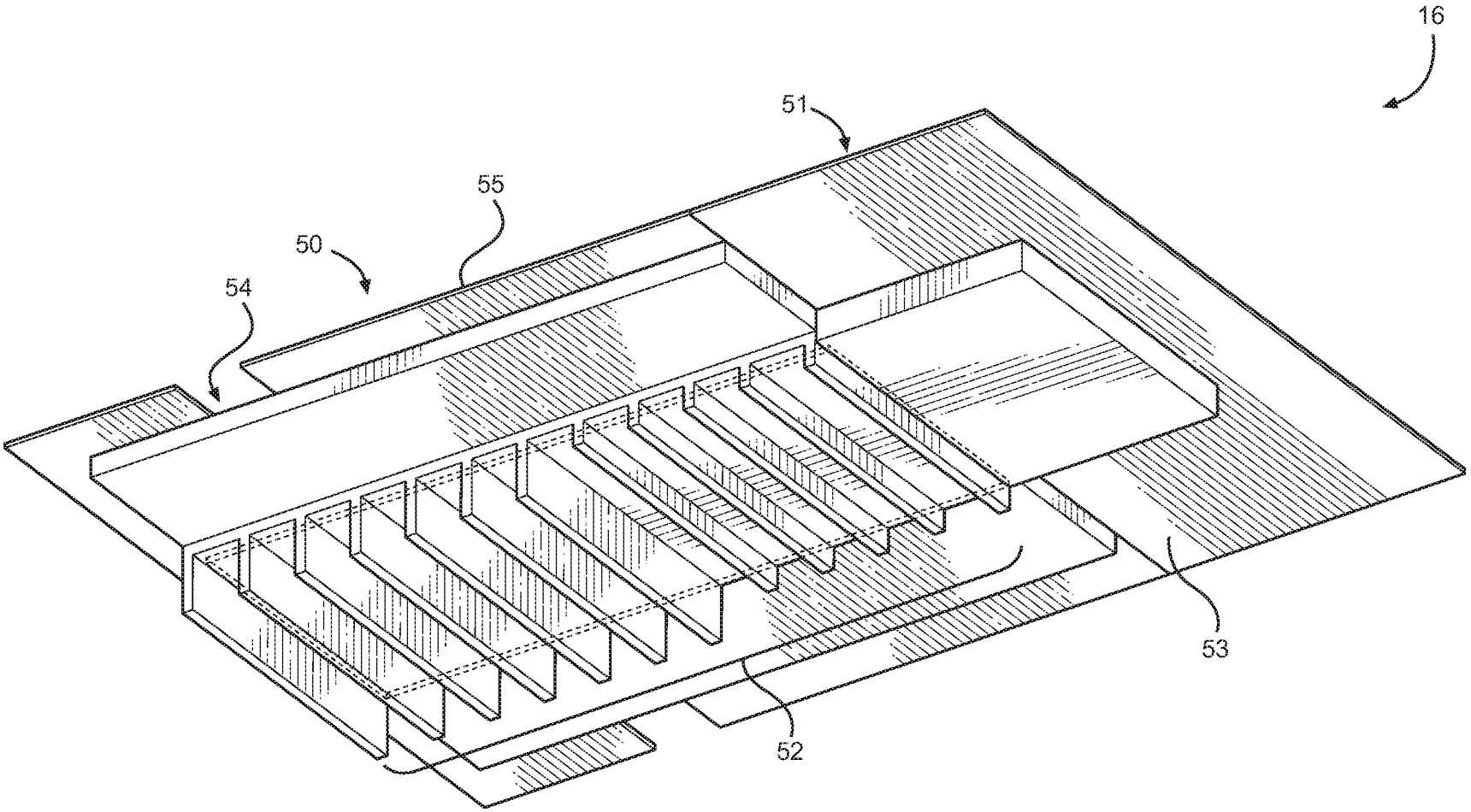
FIG. 5 shows a perspective view of the lid of an embodiment of the portable campground sink.

Referring now to FIG. 5, there is shown a perspective view of the lid of an embodiment of the portable campground sink. In the illustrated embodiment, the lid 16 comprises a first portion 50 hingedly affixed to a second portion 51, such that the second portion 51 is configured to pivot upwardly away from the container when the lid 16 is disposed thereon. In this way, the user can gain access to an interior volume of the container without removing the entire lid 16. Additionally, a user may secure a garbage bag within the exposed portion of the container when the second portion 51 is pivoted away from the container, such that the exposed portion of the interior volume can be used as a refuse storage location. In the illustrated embodiment, the lid 16 further comprises a plurality of slats 52 extending downward and perpendicularly from an underside 53 of the lid 16. The plurality of slats 52 are disposed at intervals, such that the plurality of slats 52 can receive an upright piece of dishware therebetween for drying purposes. In this way, the user can invert the lid 16 after washing dishes in the container, such that the dishes can be stored between the plurality of slats 52 to dry. In the illustrated embodiment, the lid 16 further comprises a pair of cutouts 54 disposed on opposing lateral sides 55 of the lid 16, wherein the pair of cutouts 54 are configured to expose an upper end of the container. In this way, a user can hang a sprayer or other washing or food preparation tool therefrom when not in use, rather than placing it on the ground, thereby providing convenience to the user and preventing contamination of the tool with dirt or other unsanitary elements.

Figure 6:
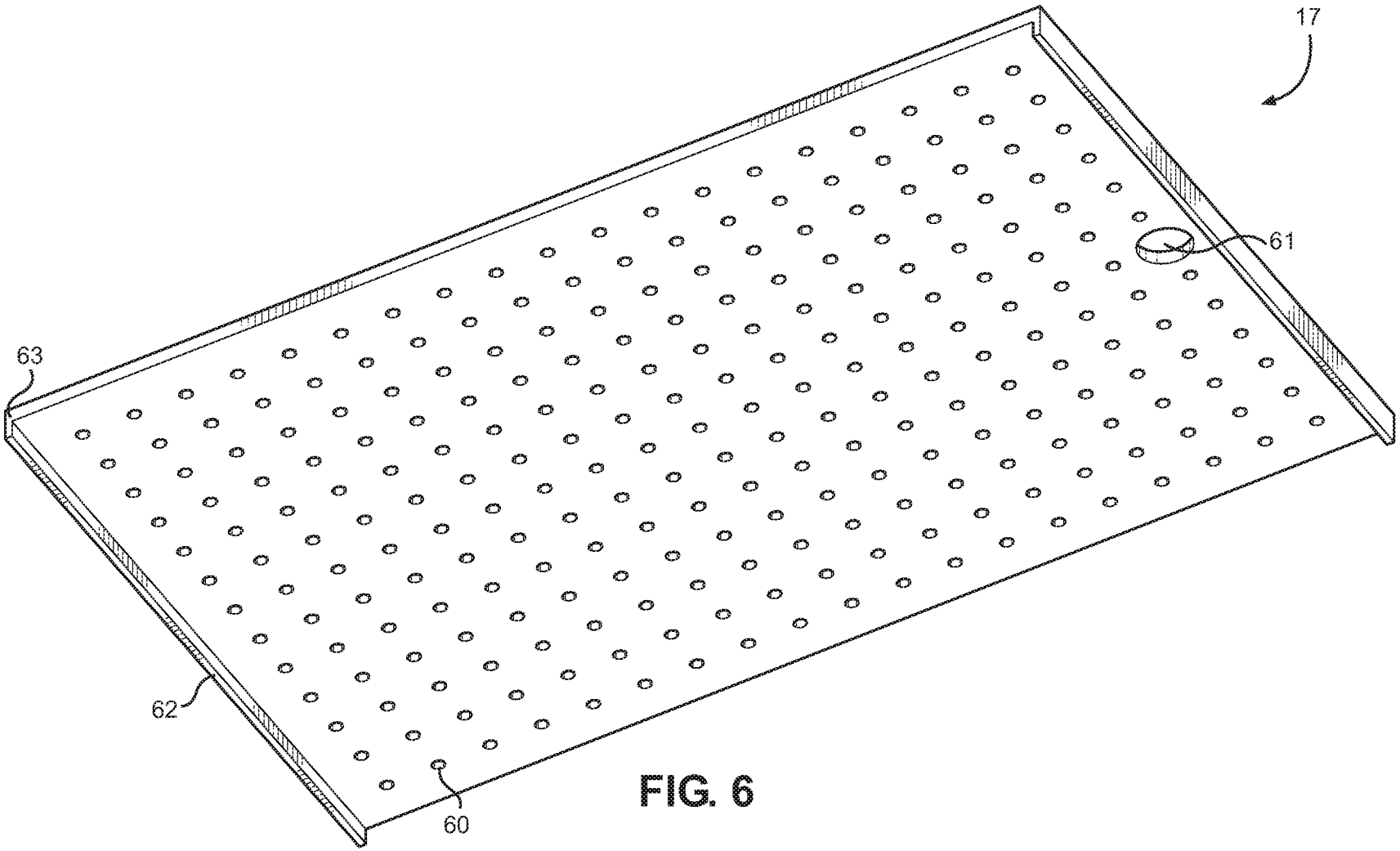
FIG. 6 shows a perspective view of the strainer of an embodiment of the portable campground sink.

Referring now to FIG. 6, there is shown a perspective view of the strainer of an embodiment of the portable campground sink. The strainer 17 is configured to rest on the base of the upper compartment so as to prevent solid debris from passing into the lower compartment. In the illustrated embodiment, the strainer 17 comprises a plurality of apertures 60 disposed thereon. The plurality of apertures 60 are configured to allow liquid to pass therethrough, while preventing solids from passing therethrough, such that the strainer 17 retains any solid debris thereon, rather than allowing the debris to pass into the lower compartment. In this way, the user can minimize the chances of obstructing the ability for the portable campground sink to drain by installing the strainer 17 within the upper compartment. In the illustrated embodiment, the strainer 17 further comprises an opening 61 at an end thereof, wherein the opening 61 is configured to receive a finger therethrough, such that the user can easily remove the strainer 17 from the upper compartment. In the illustrated embodiment, the strainer 17 further comprises a pair of supports 62 on opposing ends 63 thereof, wherein the pair of supports 62 are configured to support the strainer 17 above the base of the upper compartment, allowing liquid to drain therethrough.

Figure 7:
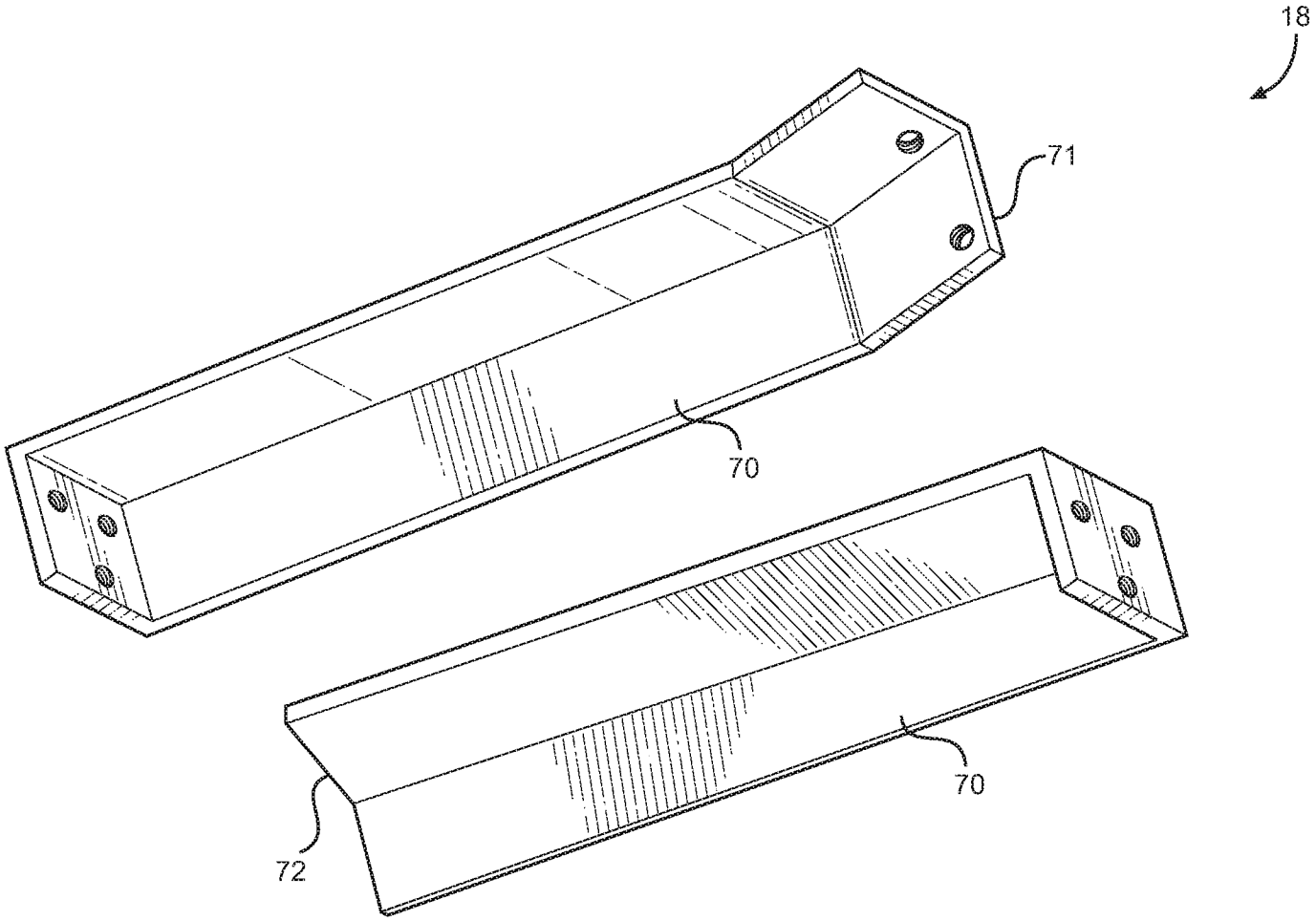
FIG. 7 shows a perspective view of one of the plurality of legs of an embodiment of the portable campground sink.

Referring now to FIG. 7, there is shown a perspective view of one of the plurality of legs of an embodiment of the portable campground sink. In the illustrated embodiment, the plurality of legs 18 comprise a plurality of segments 70 removably securable to each other, such that the height of the plurality of legs 18 is adjustable. In the illustrated embodiment, a proximal end 71 of each of the plurality of legs 18 comprises an L-shape such that the proximal end 71 can be received within the L-shaped openings in the frame. In the illustrated embodiment, a distal end 72 of each of the plurality of legs 18 is beveled. In this way, the plurality of legs 18 can bear into the ground to further secure the device to the ground. Additionally, the beveled distal end 72 allows the user to level the portable campground sink to a desired level to increase efficiency of drainage therethrough. In the illustrated embodiment, the plurality of legs 18 are angled from the proximal end 71 towards the distal end 72. In some embodiments, this angled nature begins approximately four inches from the proximal end 71, such that the plurality of legs 18 can easily secure to the frame, while the angled nature provides increased support to the portable campground sink. In some embodiments, the angle results in the proximal end 71 being offset from the distal end 72 by approximately three and a half inches.

Figure 8:
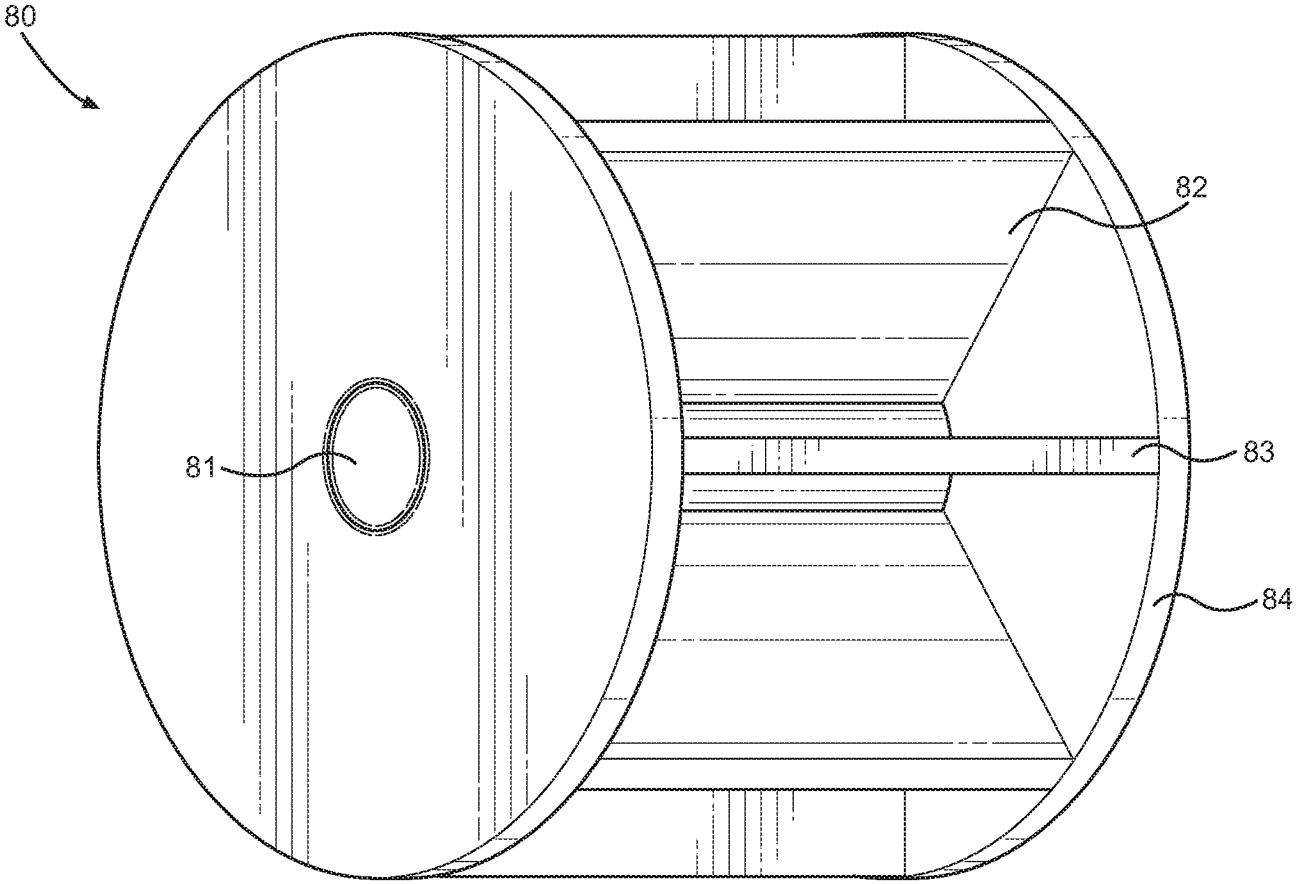
FIG. 8 shows a perspective view of the macerator wheel of an embodiment of the portable campground sink.

Referring now to FIG. 8, there is shown a perspective view of the macerator wheel of an embodiment of the portable campground sink. In the illustrated embodiment, the macerator wheel 80 comprises a spool having a plurality of panels 82 extending radially from a center of the macerator wheel 80. In some embodiments, the plurality of panels 82 extend radially from the center at a regular interval, such that the macerator wheel 80 rotates consistently at a speed designated by the flowrate of fluid through the tube. In the illustrated embodiment, a distal end 83 of the plurality of panels 82 rests flush with a perimeter of each sidewall 84 of the macerator wheel 80. In this way, the macerator wheel 80 is configured to rotate efficiently as the panels 82 do not extend beyond the perimeter of the sidewall 84, thereby ensuring that the panels 82 do not contact the lower compartment and reduce the rate of rotation. Additionally, this form factor allows the plurality of panels 82 to break apart debris most efficiently as the plurality of panels 82 comprise a maximal surface area without protruding beyond the sidewall 84. The macerator wheel 80 further comprises a channel 81 therethrough, wherein the macerator wheel 80 is configured to rotate about the channel 81 when fluid impacts the plurality of panels 82.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable campground sink, comprising:

a frame having at least one sidewall, wherein an interior portion of the frame is divided into a first section and a second section by a cross bar;

a plurality of legs removably affixed to the frame, wherein the plurality of legs extend perpendicularly away from the frame;

a container having an upper compartment defining an upper interior volume and a lower compartment disposed on a lower side of the upper compartment, wherein the lower compartment defines a lower interior volume;

wherein the upper compartment is in liquid communication with the lower compartment;

a plurality of outlets disposed in the lower compartment, wherein each outlet is configured to removably receive a hose thereon;

wherein a lower surface of the upper compartment is configured to rest flush on an upper surface of the frame such that the lower compartment is received within the first section;

an adaptor having an inlet configured to removably receive the hose thereon; and wherein an open lower end of the adaptor is in liquid communication with the inlet and is configured to removably secure within a sewer drain;

a macerator wheel comprising a pair of sidewalls along opposing lateral sides thereof, wherein a channel extends therethrough, such that the macerator wheel is configured to rotate about the channel;

a plurality of planar panels extending radially outward from the channel between the pair of sidewalls, wherein the plurality of planar panels are disposed at regular intervals;

wherein a tube in fluid communication with one of the plurality of outlets extends into the lower interior volume and is directed towards the macerator wheel, such that fluid expelled from an opening disposed on a distal end of the tube impacts one of the plurality of planar panels causing the macerator wheel to rotate about the channel.

2. The portable campground sink of claim 1, further comprising a lid configured to removably secure to an upper side of the upper compartment such that the upper interior volume is enclosed thereby.

3. The portable campground sink of claim 2, further comprising wherein the lid comprises a first portion hingedly affixed to a second portion such that the first portion is configured to pivot away from the container.

4. The portable campground sink of claim 2, wherein the lid further comprises a plurality of slats disposed at intervals extending from an underside of the lid.

5. The portable campground sink of claim 2, further comprising a pair of cutouts disposed on opposing lateral sides of the lid, wherein the pair of cutouts are configured to expose the upper side of the upper compartment.

6. The portable campground sink of claim 1, further comprising a strainer configured to rest on a base of the upper compartment, wherein the strainer comprises a plurality of apertures configured to allow liquid to pass therethrough.

7. The portable campground sink of claim 6, wherein the strainer further comprises an opening having a larger diameter than that of the plurality of apertures, the opening configured to receive a finger therethrough.

8. The portable campground sink of claim 1, wherein a base of the upper compartment is sloped towards the lower compartment.

9. The portable campground sink of claim 1, wherein a floor of the lower compartment is sloped towards the outlet.

10. The portable campground sink of claim 1, wherein the second section is configured to receive the adaptor therein.

11. The portable campground sink of claim 10, wherein the second section further comprises a lip disposed on the cross bar and an interior surface of the sidewall, wherein the lip is configured to receive the adaptor thereon.

12. The portable campground sink of claim 1, wherein the open lower end comprises a plurality of tiers of decreasing diameter from a top end of the adaptor to a bottom end of the adaptor, wherein each tier is configured to engage with a sewer drain of a corresponding diameter.

13. The portable campground sink of claim 12, wherein the plurality of tiers are configured to engage the sewer drain via threaded engagement.

14. The portable campground sink of claim 1, wherein the adaptor further comprises a cover removably secured to a top end thereof.

15. The portable campground sink of claim 1, wherein the plurality of legs comprise a plurality of segments, wherein the plurality of segments are configured to removably secure to each other to adjust the height of the plurality of legs.

16. The portable campground sink of claim 1, wherein a distal end of each of the plurality of legs is beveled.

17. The portable campground sink of claim 1, wherein a proximal end of each of the plurality of legs is received within the frame.

18. The portable campground sink of claim 17, wherein the sidewall further comprises a plurality of slots configured to allow the plurality of legs to be secured along various heights within the frame.

19. The portable campground sink of claim 1, wherein the distal end of the tube tapers inwardly from opposing sides thereof, such that the opening comprises an ovoid shape.

20. The portable campground sink of claim 1, wherein a distal end of each of the plurality of legs is offset from a proximal end thereof, such that the plurality of legs extend at an angle from the frame.

* * * * *